US006743498B2

(12) United States Patent
Fourmeux

(10) Patent No.: US 6,743,498 B2
(45) Date of Patent: Jun. 1, 2004

(54) FIREPROOF THERMALLY INSULATING BARRIER, A METHOD OF FABRICATING SUCH A BARRIER, AND A GARMENT COMPRISING AT LEAST ONE SUCH BARRIER AS INTERNAL INSULATION

(75) Inventor: Jacques Fourmeux, Maing (FR)

(73) Assignee: Duflot Industrie, S.A., Beauvois en Cambresis (FR)

( * ) Notice: Subject to any disclaimer, the term of this patent is extended or adjusted under 35 U.S.C. 154(b) by 39 days.

(21) Appl. No.: 09/980,695

(22) PCT Filed: Mar. 2, 2001

(86) PCT No.: PCT/FR01/00633

§ 371 (c)(1),
(2), (4) Date: Mar. 22, 2002

(87) PCT Pub. No.: WO01/64064

PCT Pub. Date: Sep. 7, 2001

(65) Prior Publication Data

US 2002/0142132 A1 Oct. 3, 2002

(30) Foreign Application Priority Data

Mar. 3, 2000 (FR) ..... 00 02788

(51) Int. Cl.[7] ..... A41D 1/00; A41D 13/00

(52) U.S. Cl. ..... 428/131; 2/81; 2/97; 2/459; 428/137; 428/139; 428/920; 428/921; 442/136

(58) Field of Search ..... 2/81, 97, 458; 428/131, 137, 138, 920, 921; 442/136

(56) References Cited

U.S. PATENT DOCUMENTS

| | | | | |
|---|---|---|---|---|
| 4,540,617 A | | 9/1985 | Kawanishi et al. | 428/137 |
| 5,136,723 A | * | 8/1992 | Aldridge et al. | 2/81 |
| 5,236,769 A | * | 8/1993 | Paire | 428/196 |
| 5,697,101 A | | 12/1997 | Aldridge | 2/81 |
| 5,924,134 A | * | 7/1999 | Taylor et al. | 2/81 |
| 6,341,384 B1 | * | 1/2002 | Hayes | 2/458 |

FOREIGN PATENT DOCUMENTS

| | | |
|---|---|---|
| DE | 198 27 567 A | 12/1999 |
| EP | 0 108 865 A | 5/1984 |
| EP | 0 501 080 A | 9/1992 |

OTHER PUBLICATIONS

Crosstech Products, Frequently Asked Questions, available at http://www.crosstech.com/1044976936063.html, reprinted Jun. 27, 2003.*

* cited by examiner

*Primary Examiner*—Harold Pyon
*Assistant Examiner*—Brian P. Egan
(74) *Attorney, Agent, or Firm*—Weingarten, Schurgin, Gagnebin & Lebovici LLP

(57) ABSTRACT

A fireproof thermally insulating barrier for a safety garment, the barrier having a front face for facing an external source of heat or radiation, and a rear face opposite from its front face. The barrier includes a plurality of perforations, each opening out to the front face and to the rear face of the barrier. A method of manufacturing such a barrier and a fireproof safety garment comprising at least one such barrier as internal thermal insulation are also provided.

10 Claims, 1 Drawing Sheet

FIREPROOF THERMALLY INSULATING BARRIER, A METHOD OF FABRICATING SUCH A BARRIER, AND A GARMENT COMPRISING AT LEAST ONE SUCH BARRIER AS INTERNAL INSULATION

BACKGROUND OF THE INVENTION

The invention relates to the technical field of textile materials that are thermally insulating and fireproof.

The term "thermally insulating" is used herein to mean textile materials through which heat flux densities are low when the materials are subjected to a temperature gradient.

The term "fireproof" is used herein to designate textile materials that are temperature stable, conserving good mechanical properties up to temperatures such as those that result from exposure to 400° C.

The invention relates particularly, but not exclusively, to thermally insulating linings for fireproof safety garments.

Numerous vocational activities involve a risk of being burnt directly by a flame, by an electric arc, or by splashes of hot material, or of being burned indirectly by thermal flash.

Amongst such activities, mention should naturally be made not only of firefighters and operators in pyrometallurgy, but also of the activities of the armed forces, police, airplane pilots, racing car drivers, and many others in the fields of chemistry, steel working, glassmaking, the aluminum industry, power generation, or transport, for example.

The garment linings used in these various contexts of activity must not only present good properties in terms of constituting a thermal barrier and withstanding temperature, but they must also present as little an impact as possible on the comfort of the wearer of the garment.

A safety garment that is uncomfortable runs the risk of not always being worn, and a feeling of discomfort can distract attention.

Ideally, the presence of a lining should not give rise to the garment being excessively heavy or bulky.

Also ideally, the presence of the lining should not interfere with the movements of a person nor with the evaporation of sweat.

The problem of disposing of sweat is particularly troublesome given that certain professional activities, such as those of firefighters when fighting a fire, need to be performed in a context of intense physical effort and stress and in geographical areas where the climate is already hot.

This problem is further complicated by the fact that sweating does not occur in a uniform manner over the entire surface of the body.

This problem is particularly serious when accumulated sweat in a garment tends to increase its thermal conductivity, thereby reducing its capacity as an insulating barrier.

The thermal barrier properties of the lining must not simultaneously eliminate all physical sensation of heat, since that sensation is essential.

In particular, the presence of the fireproof insulating lining must guarantee that the length of time between reaching the pain threshold and reaching the threshold of irreversible damage is always greater than the reaction time of a person wearing the fireproof garment.

Conventionally, fireproof thermally insulating linings are made of material that is fibrous and porous.

The use of fibrous and porous materials for making such linings is justified by their heat transfer properties.

This transfer takes place by radiation, by conduction, and by natural convection.

Radiation is the mode of transfer which is usually dominant in fibrous materials, particularly when the temperature gradient to which they are exposed is large.

The conduction flux density depends on the overall porosity of the fiber material, on the area per unit volume of the fibers which is representative of the extent to which the fibers are divided, and on the anisotropy with which the fibers are distributed.

In general, the natural convection flux density is limited in thermally insulating fiber materials.

The insulation obtained by a sheet of fibrous material is generally inversely proportional to the density of the material, to the density of the fibers making it up, and to the thermal conductivity of these components. This insulation is proportional to the thickness of the sheet.

The items described above show that fireproof insulating linings need to satisfy requirements that are varied and sometimes contradictory.

Three examples of such contradictions can be given.

A first example is associated with choosing a value for the porosity of the lining material.

Maximum porosity can be desired for the fibrous and porous material of the lining. The air between the fibers is a medium which is entirely transparent to radiation so only the fibers are involved in diffusing, absorbing, and re-emitting infrared radiation. However maximum porosity can give rise to poor mechanical behavior, in particular during washing and while a garment is being worn, or it can lead to the volume of the lining being excessive, thus impeding the movements of the wearer of the garment.

A second example is associated with selecting a thickness for the lining material.

A thick lining does indeed have a high level of insulating power, particularly with decreasing volume of fiber used per unit volume of the lining. However, a thick lining can impede the movements of the wearer of the garment. In addition, the lining must not be made highly thermally insulating to the detriment of a physical sensation of pain, where the pain threshold varies from one person to another.

A third example is more fundamentally associated with selecting a lining that is highly thermally insulating. Conventionally, putting a thermal barrier into place against temperature gradients going from the outside of the garment towards the inside of the garment automatically leads also to creating a thermal barrier against temperature gradients going from the inside of the garment towards the outside thereof. This can lead to a sensation of discomfort, particularly in hot or desert climates, since removal of sweat and body heat is prevented by the presence of the lining.

The need to remove heat and sweat becomes even more necessary when fireproof safety garments are thick and sometimes heavy.

Conventionally, fireproof safety garments comprise, from their outer face towards their inner face:

- an outer cloth, usually based on aramid, usually having a mass per unit area of 200 grams per square meter ($g/m^3$) to 250 $g/m^3$;
- a breathing waterproof microporous membrane of the PTFE or phosphorous-containing polyurethane, assembled on a substrate, usually of aramid fibers, or assembled on another layer;

a thermally insulating barrier, usually formed by a non-woven fabric of aramid fibers; and a cleanliness lining, usually comprising 100% aramid or 50% aramid and 50% fire resistant (FR) viscose, protecting the thermal barrier.

Various embodiments of thermally insulating and fireproof barriers have been proposed in the prior art.

Conventionally, those thermal barriers implement non-woven fabric, woven fabrics, or knits that are thermally stable and non-flammable because of the nature of the fibers used.

The thermal barriers known in the prior art satisfy the needs of their users only partially, in particular concerning their capacity for heat exchange from their inside faces towards their outside faces.

SUMMARY OF THE INVENTION

An object of the invention is to propose a fireproof, thermostable, thermally insulating barrier, enabling increased amounts of heat and body sweat to be removed, so as to maintain an impression of a second skin for a person using a garment provided with such a thermal barrier, the barrier nevertheless retaining good properties of protection against fire and against thermal flashes.

To this end, in a first aspect, the invention provides a fireproof and thermostable thermally insulating barrier, in particular for a safety garment, the barrier having a front face for facing an external source of heat or radiation, and a rear face opposite from its front face, said sheet including a plurality of holes each opening out to the front face and to the rear face of said sheet.

The size, the shape, and the density of the holes are such that the natural heat of the human body can be removed more easily, while nevertheless maintaining the thermal barrier effect for sources of heat that are external.

In various embodiments, the sheet is made from a polymer material selected from the group comprising: polyamide imides polyimides (PI) such as P.84, aramids, para-aramids, meta-aramids, polyacrylates, aromatic copolyimides, polyacrylonitriles, polyester-ether-ketone, polybenzimidazoles, polytetrafluorethylenes (PTFE), polysulfones (PSO), polyethersulfones (PES), polyphenylsulfones, and phenylene polysulfides (PPS), mixtures of aramid and polybenzimidazole, thermally stabilized mixtures of polyacrylonitrile and polyamide, polytrifluorochlorethylenes (PTFCE), copolymers of tetrafluoroethene and perfluoroprene (FEP), melamines (e.g. Basofil®) and phenolic polymers (e.g. Kynol®)

In certain embodiments, the thermal barrier is made from fibers of the above-mentioned polymer materials, or from mixtures of fibers of at least two of said polymer materials.

In particular embodiments, this thermal barrier is made of a composite material provided with a matrix based on a polymer material selected from those mentioned above and reinforcement based on short or long fibers, which can be woven or non-woven.

In various embodiments, these reinforcing fibers are selected from the group comprising metal fibers, glass fibers, "non-fire" viscose fibers, carbon fibers, peroxidized carbon fibers, modacrylic fibers.

In a low-cost embodiment, the thermal barrier is made as a composite material reinforced with recycled aramid fibers.

In a second aspect, the invention provides a method of manufacturing a sheet of the kind presented above, the method including a needling step.

In a third aspect, the invention provides a fireproof protective garment, comprising at least one fireproof thermostable thermal barrier as described above.

In certain embodiments, the garment further comprises, going from its outside face towards its inside face: an aramid-based fabric, a breathing waterproof microporous membrane, said fireproof thermostable thermal barrier, and a cleanliness lining.

By way of example, the semipermeable membrane is made from a sheet of phosphorous-containing polyurethane or PTFE, assembled on an aramid fiber substrate.

BRIEF DESCRIPTION OF THE DRAWINGS

Other objects and advantages of the invention appear from the following description of embodiments, which description is made with reference to the accompanying drawing, in which.

DETAILED DESCRIPTION OF THE PREFERRED EMBODIMENT

Figure 1:
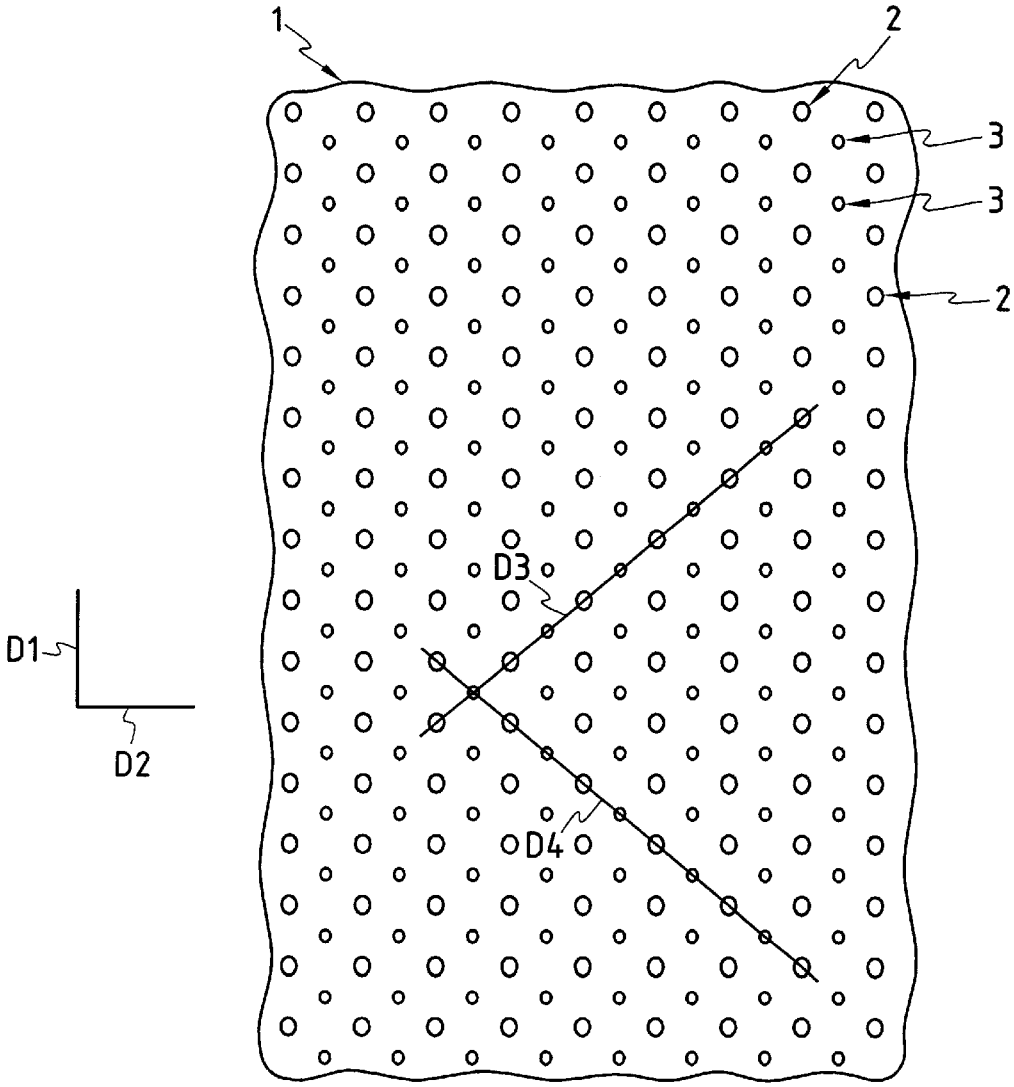
FIG. 1 is a front view of a portion of a fireproof thermostable thermal barrier constituting an embodiment of the invention.

Reference is made initially to FIG. 1, showing an embodiment of the invention.

In this embodiment, a needled non-woven fabric 1 that provides thermal insulation and fireproofing for insulating a safety garment is provided with perforations 2, 3.

This needled non-woven fabric is made from mixtures of aramid fibers such as Nomex®, Isomex®, or Kevlar® from Dupont de Nemours, or Kermel® from Rhone Poulenc, Teijin Conex® or Technora® fibers from Teijin Ltd., Twaron® from Akzo, Apyeil® from Unitika, or HMA® from Hoechst.

The table below lists some of the properties of the non-perforated non-woven fabric made from an Isomex® 5119WSM913 felt, said felt comprising a mixture of meta-aramid fibers and para-aramid fibers, of denier 1.4/1.7/2.2/6.1 dtex and of length lying in the range 38 millimeters (mm) to 140 mm.

| Characteristics | Test standard | Value | Tolerance |
|---|---|---|---|
| Weight | ISO 9073-1 | 155 g/m$^2$ | ±8% |
| Thickness under a load of 0.5 kPa | ISO 9073-2 | 2.5 mm | ±0.50 |
| Breaking strength in traction | ISO 9073-3 | | |
| Widthwise | | 290 N | >200 |
| Lengthwise | | 290 N | >200 |
| Breaking elongation in traction | ISO 9073-3 | | |
| Widthwise | | 80% | <100 |
| Lengthwise | | 55% | <80 |

Other thermostable synthetic fibers can be used, such as the following:

melamine fibers, e.g. Basofil®;

aromatic polyamide fibers, e.g. P84® from Lenzing;

phenolic fibers, e.g. Kynol® from Nippon Kynol or Philene® from Saint Gobain;

pan preox fibers, e.g. Panox® from RK Carbon Ltd., or Sigrafil® from Sigri;

polyacrylate fibers, e.g. Inidex® from Courtaulds; and polybenzimidazole fibers, e.g. PBI® from Hoechest Celanese.

In most applications, a suitable weight for the non-woven felt lies in the range 100 g/m$^2$ to 200 g/m$^2$.

The aramid fibers used can be derived from recycling, e.g. scrap.

In the embodiment shown, the perforations made through the needled non-woven sheet are circular holes 2, 3 of two different diameters.

In FIG. 1, in order to make the description easier to understand, directions D1 and D2 are defined as the longitudinal and transverse directions respectively.

The terms "longitudinal" and "transverse" are used for convenience and do not determine the orientation of the sheet in use.

In the embodiment shown, a first type of hole 2 has a diameter of about 3 millimeters while a second type of hole 3 has a diameter of about 2 millimeters.

The larger diameter holes 2 are disposed in a rectangular mesh pattern.

The smaller diameter holes 3 are disposed in the same rectangular mesh pattern, with the two patterns being offset by half a mesh size.

As a result, the smaller diameter holes are disposed in equidistant longitudinal lines that are spaced apart identically to the spacing of the larger diameter holes.

Similarly, the larger diameter holes are disposed in equidistant transverse lines that are spaced apart identically to the spacing between the smaller diameter holes.

When seen along two directions D3, D4 that are oblique relative to the directions D1, D2, the holes 2, 3 are in lines.

The four neighboring holes closest to each smaller diameter hole 3 are larger diameter holes 2 disposed in the mesh of their array.

Similarly, the four neighboring holes closest to each larger diameter hole 2 are smaller diameter holes 3, disposed in the mesh of their array.

The density of the holes is of the order of two to three holes per square centimeter.

Perforation enables the weight of the sheet to be reduced by about 20% to 30%.

Other forms of hole could be envisaged, as could other patterns of holes.

The thermal barrier can also have more than two types of hole.

In certain embodiments, perforation density is not uniform.

Thus, when the thermal barrier 1 is installed as insulation in a fireproof garment, a greater density of holes can be provided for those regions of the body that, a priori, are relatively little exposed to the risk of being burnt directly or indirectly.

Similarly, if the thermal barrier 1 is used as insulation in a fireproof protective hood, then the perforations can be more numerous over the ears of the wearer of the hood.

In the embodiment shown, the perforations are disposed in a pattern that is simple and regular.

Amongst other advantages, this type of embodiment presents the advantage of making it easier to model the thermal and mechanical behavior of the fireproof insulating thermostable thermal barrier.

Naturally, irregular patterns can be envisaged, depending on requirements.

The fireproof insulating thermostable thermal barrier made of needled non-woven fabric is flexible, being about one to five millimeters thick, for example.

Figure 2:
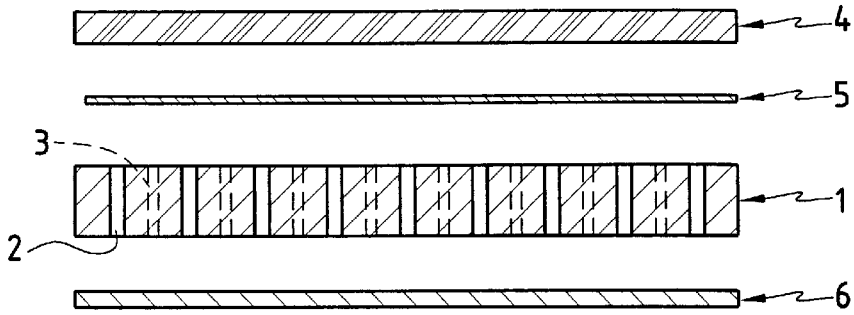
FIG. 2 is a section view through a fireproof garment including a thermal barrier as shown in FIG. 1.

Reference is now made to FIG. 2.

FIG. 2 is a diagrammatic cross-section through the structure of a protective garment comprising at least one thermal barrier 1 as internal insulation.

For reasons of clarity, the various garment layers are shown as being spaced apart from one another in FIG. 2.

The relative thickness of the various layers are not exact, and the thickness of the lining has been exaggerated for reasons of clarity.

Going from its outside face towards its inside face, the fireproof safety garment comprises:

an outer cloth 4;

a microporous membrane 5;

said fireproof thermostable thermal barrier; and an inner cleanliness lining 6.

The resistance to evaporation of garments of the above type, when provided with a conventional lining, generally lies in the range 22 bar square meters per watt (bar.m$^2$/W) to 30 bar.m$^2$/W.

Such values are obtained, for example, when using a needled non-woven fabric of Isomex® fibers weighing 100 g/m$^2$.

The use of Nomex® type fibers makes it possible to reduce this value of resistance to evaporation to below 22 bar.m$^2$/W.

Making perforations through an Isomex® needled non-woven fabric enables the value of resistance to evaporation to be improved by 10% to 30%.

In certain embodiments, the outer cloth 4 is substantially waterproof.

This property is particularly important for certain actions taken by firefighters or when the atmosphere in which action is being taken is potentially harmful or toxic.

In certain embodiments, the outer cloth is provided with phosphorescent and/or fluorescent strips.

By way of example, the microporous membrane 5 is made of Gore-tex® or is of the phosphorous-containing polyurethane type assembled on a substrate of aramid fibers.

Depending on the expected exposure temperatures, various types of fiber can be used for making a non-woven thermal barrier 1.

For exposure to high temperatures, it is possible to use fibers of the following types:

polyamide imides, polyimides (PI);

aramids such as Kermel®, Teijin Conex®, Kevlar®, Twaron®, Tecnora®;

para-aramids, meta-aramids;

polyacrylate such as Inidex®;

aromatic copolyimide;

polyacrylonitrile;

polyester-ether-ketone;

polybenzimidazole, e.g. PBI® fibers from Celanise Corp.;

polytetrafluorethylene (PTFE);

modacrylics;

polyphenylsulfone; and phenylene polysulfide (PPS).

It is also possible to use mixtures of fibers of the above type, and in particular:

a mixture of aramid and of polybenzimidazole;

thermally stabilized mixtures of polyacrylonitrile and polyamide.

Where appropriate, the above-mentioned fibers, and in particular polyaramids, can be mixed with glass fibers, carbon fibers, or silica fibers.

When exposure to lower temperatures is expected, it is possible to use fibers of the following types:

polytrifluorochlorethylene (PTFCE);

a copolymer of tetrafluoroethene and perfluoroprene (i.e. fluorinated-ethlene-propylene (FEP));

polysulfone (PSO); and polyethersulfone (PES).

When mechanical strength and the ability to withstand washing are more particularly desired for the perforated needled non-woven felts, it can be sewn to a fireproof membrane, using lines of stitches that are not rectilinear but that are sinuous, for example.

What is claimed is:

1. A fireproof and thermostable thermally insulating barrier, in particular for a safety garment, the barrier being in the form of a non-woven fabric, the barrier having a front face for facing an external source of heat or radiation, and a rear face opposite from its front face, and;

the barrier including a plurality of circular holes each opening out to the front face and to the rear face of said sheet;

wherein the holes are of two types, each type of hole having a diameter that is different from the diameter of the other type of hole, wherein the first type of hole has a diameter of about three millimeters and the second type of hole has a diameter of about two millimeters; and wherein the density of holes is about two per square centimeter.

2. An insulating barrier according to claim 1, wherein the two patterns are offset by half the mesh size.

3. An insulating barrier according to claim 1, wherein its thickness is about five millimeters.

4. An insulating barrier according to claim 1, the barrier being made from recycled aramid fibers.

5. A method of manufacturing an insulating barrier as presented in claim 1, wherein the method includes a needling step.

6. An insulating barrier according to claim 1, the barrier being made from a material selected from the group comprising: polyamide imides, polyimides (PI), aramids, para-aramids, meta-aramids, polyacrylates, aromatic copolyimides, polyacrylonitriles, polyester-ether-ketone, polybenzimidazole, polytetrafluorethylene (PTFE), polysulfones (PSO), polyethersulfones (PES), polyphenylsulfones, and phenylene polysulfides (PPS), mixtures of aramid and polybenzimidazole, thermally stabilized mixtures of polyacrylonitrile and polyamide, polytrifluorochlorethylenes (PTFCE), copolymers of tetrafluoroethene and perfluoroprene (FEP).

7. An insulating barrier according to claim 6, the barrier being made from a material further comprising fibers selected from the group comprising: metal fibers, glass fibers, "non-fire" viscose fibers, carbon fibers, peroxided carbon fibers, silica fibers, modacrylic fibers.

8. A fireproof protective garment, comprising at least one thermally insulating barrier as presented in claim 1 as internal insulation.

9. A garment according to claim 8, characterized in that it comprises:

an aramid-based outer cloth;

a breathing waterproof microporous membrane;

said thermally insulating barrier; and an internal cleanliness lining.

10. A garment according to claim 8, wherein the microporous membrane is made from a sheet of phosphorous-containing polyurethane, assembled to a substrate of aramid fibers.

* * * * *

UNITED STATES PATENT AND TRADEMARK OFFICE

CERTIFICATE OF CORRECTION

PATENT NO. : 6,743,498 B2
DATED : June 1, 2004
INVENTOR(S) : J. Fourmeux

It is certified that error appears in the above-identified patent and that said Letters Patent is hereby corrected as shown below:

Column 7,
Line 28, should delete the word -- and --.
Line 30, should delete the (period) "." and insert semicolon -- ; -- where the period was.
Line 30, after the semicolon ";" insert the Examiners Amdt. C5.

Signed and Sealed this

Fourteenth Day of December, 2004

JON W. DUDAS
*Director of the United States Patent and Trademark Office*